US010347185B2

(12) United States Patent
Hou

(10) Patent No.: US 10,347,185 B2
(45) Date of Patent: Jul. 9, 2019

(54) ORGANIC LIGHT-EMITTING DIODE (OLED) PIXEL CIRCUITS, DRIVING METHOD THEREOF, AND OLED DISPLAYS

(71) Applicant: Wuhan China Star Optoelectronics Semiconductor Display Technology Co., Ltd., Wuhan, Hubei (CN)

(72) Inventor: Xueshun Hou, Guangdong (CN)

(73) Assignee: Wuhan China Star Optoelectronics Semiconductor Display Technology Co., Ltd., Wuhan, Hubei (CN)

( * ) Notice: Subject to any disclaimer, the term of this patent is extended or adjusted under 35 U.S.C. 154(b) by 0 days.

(21) Appl. No.: 15/577,245

(22) PCT Filed: Sep. 21, 2017

(86) PCT No.: PCT/CN2017/102587

§ 371 (c)(1),
(2) Date: Nov. 27, 2017

(87) PCT Pub. No.: WO2019/037184

PCT Pub. Date: Feb. 28, 2019

(65) Prior Publication Data

US 2019/0066584 A1 Feb. 28, 2019

(51) Int. Cl.
*G09G 3/3258* (2016.01)

(52) U.S. Cl.
CPC ... *G09G 3/3258* (2013.01); *G09G 2300/0819* (2013.01); *G09G 2320/045* (2013.01)

(58) Field of Classification Search
CPC ..... G09G 3/3258; G09G 2300/0819; G09G 2320/045
See application file for complete search history.

(56) References Cited

U.S. PATENT DOCUMENTS

2006/0023551 A1 2/2006 Peng et al.
2009/0040150 A1* 2/2009 Senda ..... G09G 3/3233 345/76
2009/0167648 A1* 7/2009 Jeon ..... G09G 3/3233 345/76
2010/0073266 A1* 3/2010 Na ..... G09G 3/3233 345/76
2014/0176404 A1 6/2014 Qian et al.
(Continued)

FOREIGN PATENT DOCUMENTS

CN 104485071 A 4/2015

*Primary Examiner* — Dmitriy Bolotin
(74) *Attorney, Agent, or Firm* — Andrew C. Cheng

(57) ABSTRACT

The present disclosure relates to an organic light-emitting diode (OLED) pixel circuit, a driving method thereof, and an OLED display. The OLED pixel circuit may include a first transistor, the storage capacitance, a second transistor, a light-emitting component, and a threshold compensation circuit. A control end of the first transistor connects to an input end of scanning signals, a first end of the first transistor connects to an input end of the data signals, and a second end of the first transistor connects to a first end of the storage capacitance. A control end of the second transistor connects to a second end of the storage capacitance, a first end of the second transistor connects to an input end of the first control signals, and a second end of the second transistor connects to a first end of the light-emitting component.

17 Claims, 3 Drawing Sheets

(56) References Cited

U.S. PATENT DOCUMENTS

| | | | | |
|---|---|---|---|---|
| 2014/0240368 | A1* | 8/2014 | Koh | G09G 3/3258 345/690 |
| 2016/0117983 | A1 | 4/2016 | Li et al. | |
| 2016/0180772 | A1 | 6/2016 | Ma | |
| 2016/0275866 | A1 | 9/2016 | Liu et al. | |
| 2017/0221422 | A1 | 8/2017 | Hwang et al. | |

* cited by examiner

ORGANIC LIGHT-EMITTING DIODE (OLED) PIXEL CIRCUITS, DRIVING METHOD THEREOF, AND OLED DISPLAYS

BACKGROUND

1. Technical Field

The present disclosure relates to display field, and more particularly to an organic light-emitting diode (OLED) pixel circuit, a driving method thereof, and an OLED display.

2. Description of Related Art

Organic light-emitting diode (OLED) display has become a competitive display due to attributes, such as wide color gamut, high contrast, low power consuming, and foldable. Active-matrix organic light emitting diode (AMOLED) is one of the most important techniques in flexible display flied.

The driving circuit of the AMOLED may include a switch thin film transistor (TFT), a driver TFT, and a storage capacitance $C_{st}$. Driving current of the OLED may be controlled by the driver TFT, and the driving current $I_{OLED}=k(V_{gs}-V_{th})^2$. Wherein k is the current amplification factor of the driver TFT, which is defined by the character of the driver TFT. $V_{gs}$ is the voltage between the gate and the source of the driver TFT. $V_{th}$ is the threshold voltage of the driver TFT. However, the threshold voltage $V_{th}$ of the driver TFT may drift easily, resulting in the changes of the driving current of the OLED, and the defect of the OLED panel, which may reduce the display quality.

SUMMARY

The present disclosure relates to an OLED pixel circuit, including: at least one pixel circuit, wherein the pixel circuit comprises: a first transistor, a storage capacitance, a second transistor, a light-emitting component, and a threshold compensation circuit; a control end of the first transistor connects to an input end of scanning signals, a first end of the first transistor connects to an input end of data signals, and a second end of the first transistor connects to a first end of the storage capacitance; a control end of the second transistor connects to a second end of the storage capacitance, a first end of the second transistor connects to an input end of first control signals, a second end of the second transistor connects to the first end of the light-emitting component, and a second end of the light-emitting component is grounded; the threshold compensation circuit is configured to obtain a threshold voltage and a gate voltage of the second transistor when the light-emitting component is activated to eliminate an impact on a driving current of the light-emitting component caused by the threshold voltage of the second transistor.

In another aspect, the present disclosure relates to a driving method of an OLED, including: configuring an input end of reset voltage to be at a low potential, an input end of scanning voltage to be at a high potential, and an input end of a third control signals to be at the high potential in a first phase; configuring an input end of scanning signals to be at the low potential, an input end of the reset voltage to be at the high potential in a second phase; configuring the input end of the scanning signals to be at the high potential, and an input end of a third control signals to be at the low potential in a third phase.

In another aspect, the present disclosure relates to an OLED display, including the OLED pixel circuit described above or adopting the driving method described above.

In view of the above, the OLED pixel circuit of the present disclosure may include the first transistor, the storage capacitance, the second transistor, the light-emitting component, and the threshold compensation circuit. Wherein the control end of the first transistor connects to the input end of scanning signals, the first end of the first transistor connects to the input end of the data signals, and the second end of the first transistor connects to the first end of the storage capacitance. The control end of the second transistor connects to the second end of the storage capacitance, the first end of the second transistor connects to the input end of the first control signals, and the second end of the second transistor connects to the first end of the light-emitting component. As such, the threshold compensation circuit may be configured to obtain the threshold voltage and the gate voltage of the second transistor when the light-emitting component is activated. So as to eliminate the impact on the driving current of the light-emitting component caused by the threshold voltage of the second transistor, and to improve the performance of the display.

DETAILED DESCRIPTION

To clarify the purpose, technical solutions, and the advantages of the disclosure, embodiments of the invention will now be described more fully hereinafter with reference to the accompanying drawings, in which embodiments of the invention are shown. The figure and the embodiment described according to figure are only for illustration, and the present disclosure is not limited to these embodiments.

It should be noted that the relational terms herein, such as "first" and "second", are used only for differentiating one entity or operation, from another entity or operation, which, however do not necessarily require or imply that there should be any real relationship or sequence. Moreover, the terms "comprise", "include" or any other variations thereof are meant to cover non-exclusive including, so that the process, method, article or device comprising a series of elements do not only comprise those elements, but also comprise other elements that are not explicitly listed or also comprise the inherent elements of the process, method, article or device. In the case that there are no more restrictions, an element qualified by the statement "comprises a . . . " does not exclude the presence of additional identical elements in the process, method, article or device that comprises the said element.

It is believed that certain improvements and modifications may be made by those skilled in the art without departing from the principles of the present application, and such improvements and modifications shall be regarded as the scope of the present application.

Figure 1:
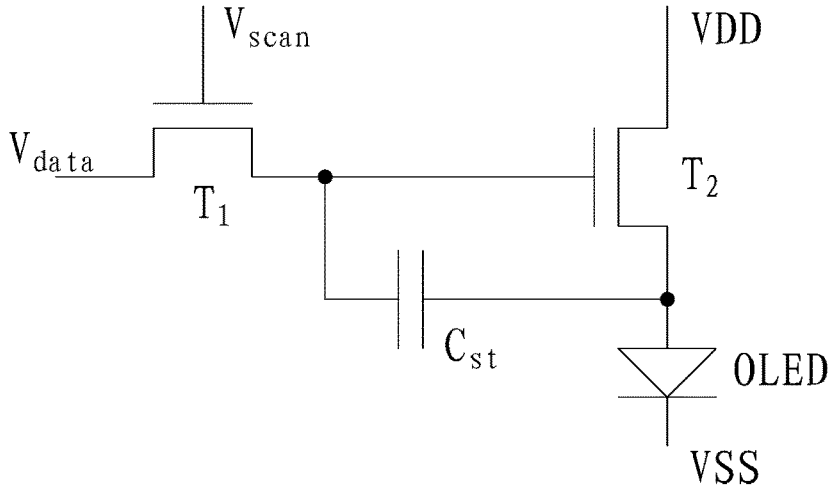
FIG. 1 is a schematic view of a conventional substrate-driving circuit of an organic light-emitting diode (OLED).

FIG. 1 is a schematic view of a conventional substrate-driving circuit of an organic light-emitting diode (OLED).

A substrate-driving circuit may include a switch thin film transistor (TFT) T1, a driver TFT T2, and a storage capacitance Cst. Driving current of the OLED may be controlled by the driver TFT, and the driving current $I_{OLED}=k(V_{gs}-V_{th})^2$. Wherein k is the current amplification factor of the driver TFT, which is defined by the character of the driver TFT. $V_{gs}$ is the voltage between the gate and the source of the driver TFT. $V_{th}$ is the threshold voltage of the driver TFT. However, the threshold voltage $V_{th}$ of the driver TFT may drift easily, resulting in the changes of the driving current of the OLED, and the defect of the OLED panel, which may reduce the display quality.

Figure 2:
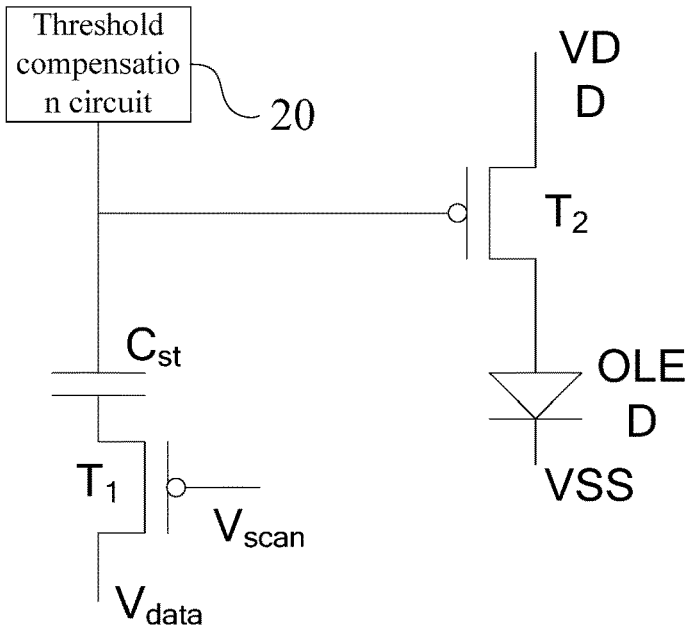
FIG. 2 is a schematic view of an OLED pixel circuit in accordance with one embodiment of the present disclosure.

Referring to FIG. 2, the present disclosure relates to an OLED pixel circuit, including: a first transistor T1, a storage capacitance Cst, a second transistor T2, a light-emitting component OLED, and a threshold compensation circuit 20.

Wherein a control end of the first transistor T1 connects to an input end of scanning signals, a first end of the first transistor T1 connects to an input end of the data signals Vdata, and a second end of the first transistor T1 connects to a first end of the storage capacitance Cst. A control end of the second transistor T2 connects to a second end of the storage capacitance Cst, a first end of the second transistor T2 connects to an input end of the first control signals VDD, and a second end of the second transistor T2 connects to a first end of the light-emitting component OLED. As such, the threshold compensation circuit 20 may be configured to obtain a threshold voltage Vth and a gate voltage Vg of the second transistor T2 when the light-emitting component OLED is activated. So as to eliminate an impact on a driving current of the light-emitting component OLED caused by the threshold voltage Vth of the second transistor T2.

Figure 3:
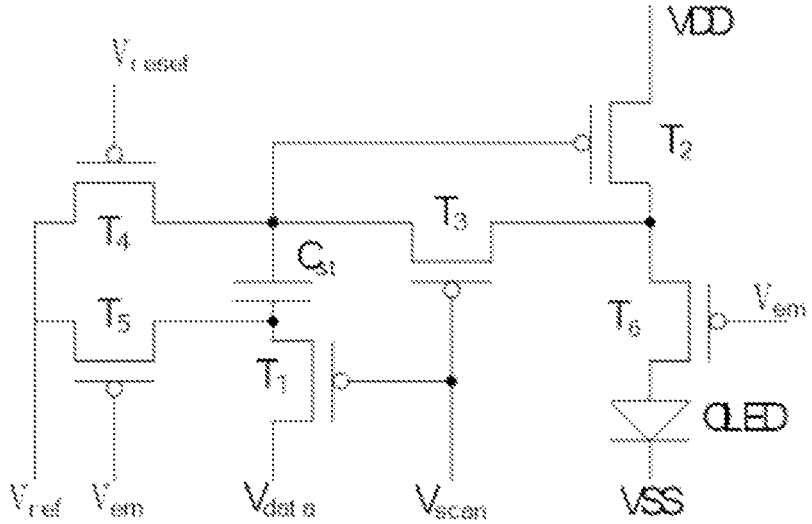
FIG. 3 is a schematic view of an OLED pixel circuit in accordance with another embodiment of the present disclosure.

FIG. 3 is a schematic view of the OLED pixel circuit in accordance with another embodiment of the present disclosure.

Wherein the control end of the first transistor T1 connects to the input end of scanning signals, the first end of the first transistor T1 connects to the input end of the data signals Vdata, and the second end of the first transistor T1 connects to the first end of the storage capacitance Cst. The control end of the second transistor T2 connects to the second end of the storage capacitance Cst, the first end of the second transistor T2 connects to the input end of the first control signals VDD, and the second end of the second transistor T2 connects to the first end of the light-emitting component OLED.

The threshold compensation circuit may include: a third transistor T3, a fourth transistor T4, a fifth transistor T5, and a sixth transistor T6. Wherein a control end of the third transistor T3 connects to the input end of the scanning signals Vscan, a first end of the third transistor T3 connects to the control end of the second transistor T2, and the second end of the third transistor T3 connects to the second end of the second transistor T2. A control end of the fourth transistor T4 connects to an input end of reset signals Vreset, a first end of the fourth transistor T4 connects to an input end of second control signals Vref, and a second end of the fourth transistor T4 connects to the control end of the second transistor T2. A control end of the fifth transistor T5 connects to an input end of a third control signals Vem, a first end of the fifth transistor T5 connects to the input end of the second control signals Vref, and a second end of the fifth transistor T5 connects to the second end of the first transistor T1. A control end of the sixth transistor T6 connects to the input end of the third control signals Vem, a second end of the sixth transistor T6 connects to the second end of the second transistor T2, and a second end of the sixth transistor T6 connects to a first end of the light-emitting component OLED.

In one example, the first transistor T1, the second transistor T2, the third transistor T3, the fourth transistor T4, the fifth transistor T5, and the sixth transistor T6 may be P-type TFTs.

The P-type TFT may include a gate, a source, and a drain. The gate, the source, and the drain of the P-type TFT respectively corresponds to the control end, the first end, and the second end of the transistor. When gate voltage is at low potential, the source and the drain are turned on. When the gate voltage is at a high potential, the source and the drain are turned off.

In one example, the light-emitting component OLED may be a light-emitting diode (LED), wherein a second end of the LED is grounded or connect to low potential signals.

Figure 4:
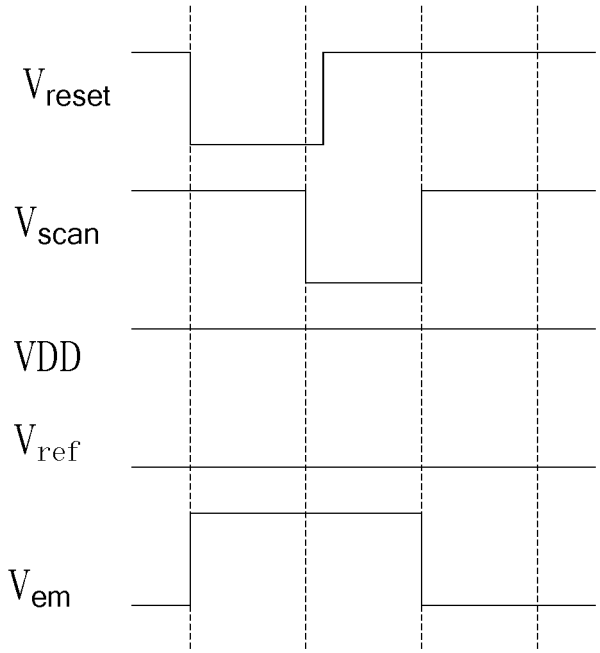
FIG. 4 is a diagram illustrating signal timing of an OLED pixel circuit in accordance with another embodiment of the present disclosure.

FIG. 4 is a diagram illustrating signal timing of the OLED pixel circuit in accordance with another embodiment of the present disclosure.

The first control signals VDD and the second control signals Vref are direct current (DC) voltage signals. Specifically, the first control signals VDD are high-level DC voltage signals and the second control signals Vref are low-level DC voltage signals.

The scanning signals Vscan may be provided by at least one scanning line, and the data signals Vdata may be provided by a least one data line.

Operation of the circuit of the present disclosure is described as follow.

In a first phase, the input end of the reset voltage Vreset is configured to be at the low potential, the input end of the scanning voltage Vscan is configured to be at the high potential, and the input end of the third control signals Vem is configured to be at the high potential. As such, the fourth transistor T4 may be turned on, and the gate voltage of the second transistor T2 may be reset to the reset voltage Vreset, i.e., the gate voltage of the second transistor T2 may be reset to the low potential.

In a second phase, the input end of the scanning signals Vscan is configured to be at the low potential. After a predetermined time, the input end of the reset voltage Vreset is configured to be at the high potential, that is, the low potential of the scanning signals Vscan partially overlap with the low potential of the reset voltage Vreset in the second phase. As such, the first transistor T1 and the third transistor T3 are turned on, and the fourth transistor T4 is turned off, so as to obtain the threshold voltage Vth of the second transistor T2. The second end (upper-level plate) of the storage capacitance Cst may be charged via the second transistor T2 and third transistor T3 until the second transistor T2 is turned off. The gate voltage $V_{g1}$ of the second transistor T2 may be $V_{g1}=V_{DD}+V_{th}$, and the data signals Vdata may be stored in the storage capacitance Cst.

In a third phase, the input end of the scanning signals Vscan is configured to be at the high potential, the input end of the third control signals Vem is configured to be at the low potential. As such, gate voltage $V_{g2}$ of the second transistor T2 may be configured to be as $V_{g2}=V_{ref}-V_{data}+V_{DD}+V_{th}$.

Source voltage of the second transistor T2 may be configured to be as $V_S=V_{DD}$. Putting the relation Vg2=Vref–

Vdata+$V_{DD}$+$V_{th}$ and $V_S$=$V_{DD}$ into the formula $I_{OLED}$=k$(V_{gs}-V_{th})^2$. So that, the driving current $I_{OLED}$=k$(V_{ref}-V_{data}+V_{DD}+V_{th}-V_{DD}-V_{th})^2$=k $(V_{ref}-V_{data})^2$ may be obtained.

According to the equation, the driving current $I_{OLED}$ only relates to current amplification factor k, the second control signals $V_{ref}$, and the data signals $V_{data}$, and the driving current $I_{OLED}$ may not relate to the threshold voltage of the second transistor T2. Such that, the impact on the driving current of the light-emitting component OLED caused by the threshold voltage of the second transistor may be eliminated.

In view of the above, the OLED pixel circuit of the present disclosure may include the first transistor, the storage capacitance, the second transistor, the light-emitting component, and the threshold compensation circuit. Wherein the control end of the first transistor connects to the input end of scanning signals, the first end of the first transistor connects to the input end of the data signals, and the second end of the first transistor connects to the first end of the storage capacitance. The control end of the second transistor connects to the second end of the storage capacitance, the first end of the second transistor connects to the input end of the first control signals, and the second end of the second transistor connects to the first end of the light-emitting component. As such, the threshold compensation circuit may be configured to obtain the threshold voltage and the gate voltage of the second transistor when the light-emitting component is activated. So as to eliminate the impact on the driving current of the light-emitting component caused by the threshold voltage of the second transistor, and to improve the performance of the display.

Figure 5:
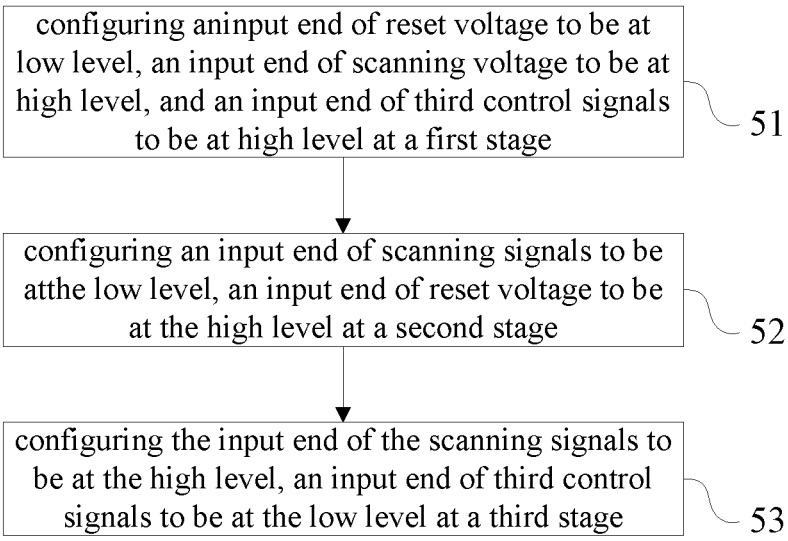
FIG. 5 is a flowchart illustrating a driving method of an OLED pixel circuit in accordance with one embodiment of the present disclosure.

FIG. 5 is a flowchart illustrating a driving method of the OLED pixel circuit in accordance with one embodiment of the present disclosure. Wherein the OLED pixel circuit may refer to FIG. 2 or FIG. 3. The driving method may include the following steps.

In Step 51: configuring the input end of the reset voltage $V_{reset}$ to be at the low potential, the input end of the scanning voltage $V_{scan}$ to be at the high potential, and the input end of the third control signals $V_{em}$ to be at the high potential in the first phase.

In step 52: configuring the input end of the scanning signals $V_{scan}$ to be at the low potential, the input end of the reset voltage $V_{reset}$ to be at the high potential in the second phase.

In step 53: configuring the input end of the scanning signals $V_{scan}$ to be at the high potential, the input end of the third control signals $V_{em}$ to be at the low potential in the third phase.

Operation of the circuit of the present disclosure is described as follow.

In the first phase, the input end of the reset voltage $V_{reset}$ is configured to be at the low potential, the input end of the scanning voltage $V_{scan}$ is configured to be at the high potential, and the input end of the third control signals $V_{em}$ is configured to be at the high potential. As such, the fourth transistor T4 may be turned on, and the gate voltage of the second transistor T2 may be reset to the reset voltage $V_{reset}$, i.e., the gate voltage of the second transistor T2 may be reset to the low potential.

In the second phase, the input end of the scanning signals $V_{scan}$ is configured to be at the low potential. After the predetermined time, the input end of the reset voltage $V_{reset}$ is configured to be at the high potential, that is, the low potential of the scanning signals $V_{scan}$ partially overlap with the low potential of the reset voltage $V_{reset}$ in the second phase. As such, the first transistor T1 and the third transistor T3 are turned on, and the fourth transistor T4 is turned off, so as to obtain the threshold voltage Vth of the second transistor T2. The second end of the storage capacitance $C_{st}$ may be charged via the second transistor T2 and third transistor T3 until the second transistor T2 is turned off. The gate voltage of the second transistor T2 may be $V_{g1}$=$V_{DD}$+$V_{th}$, and the data signals $V_{data}$ may be stored in the storage capacitance $C_{st}$.

In the third phase, the input end of the scanning signals $V_{scan}$ is configured to be at the high potential, the input end of the third control signals $V_{em}$ is configured to be at the low potential. As such, gate voltage Vg2 of the second transistor T2 may be configured to be as $V_{g2}$=$V_{ref}-V_{data}+V_{DD}+V_{th}$.

The Source voltage of the second transistor T2 may be configured to be as $V_S$=$V_{DD}$. Putting the relation $V_{g2}$=$V_{ref}$f$-V_{data}+V_{DD}+V_{th}$ and $V_S$=$V_{DD}$ into the formula $I_{OLED}$=k$(V_{gs}-V_{th})^2$. So that, the driving current $I_{OLED}$=k$(V_{ref}-V_{data}+V_{DD}+V_{th}-V_{DD}-V_{th})^2$=k $(V_{ref}-V_{data})^2$ may be obtained.

According to the equation, the driving current $I_{OLED}$ only relates to current amplification factor k, the second control signals $V_{ref}$, and the data signals $V_{data}$, and the driving current $I_{OLED}$ may not relate to the threshold voltage of the second transistor T2. Such that, the impact on the driving current of the light-emitting component OLED caused by the threshold voltage of the second transistor may be eliminated.

Figure 6:
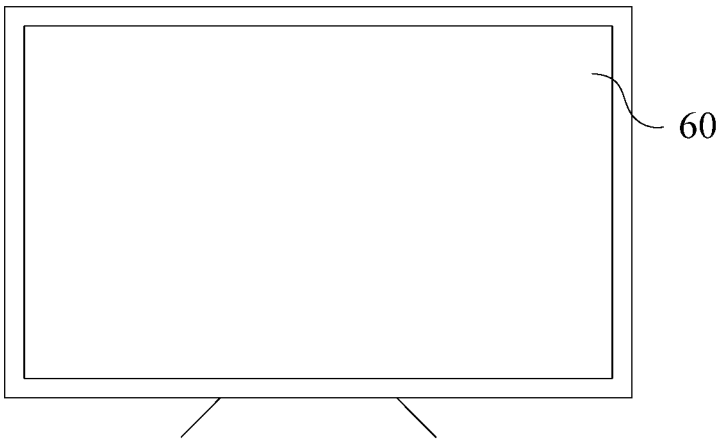
FIG. 6 is a schematic view of an OLED display in accordance with one embodiment of the present disclosure.

Referring to FIG. 6, the present disclosure further relates to an OLED display 60, including an array substrate. Wherein the array substrate may include a plurality of pixels arranged in array, a plurality of scanning lines, and a plurality of data lines. The scanning lines and the data lines are configured to respectively provide the scanning signals and the data signals to the pixel arranged on the same row or same column.

Each of the pixels is configured with the pixel circuit, wherein the pixel circuit may be the pixel circuit described in above. The input end of the scanning signals $V_{scan}$ of the pixel circuit connects to the corresponding scanning lines configured on the same row, and the input end of the data signals $V_{data}$ of the pixel circuit connects to the corresponding data lines configured on the same column.

The driving method of the pixel circuit is described in above.

In view of the above, the OLED pixel circuit of the present disclosure may include the first transistor, the storage capacitance, the second transistor, the light-emitting component, and the threshold compensation circuit. Wherein the control end of the first transistor connects to the input end of scanning signals, the first end of the first transistor connects to the input end of the data signals, and the second end of the first transistor connects to the first end of the storage capacitance. The control end of the second transistor connects to the second end of the storage capacitance, the first end of the second transistor connects to the input end of the first control signals, and the second end of the second transistor connects to the first end of the light-emitting component. As such, the threshold compensation circuit may be configured to obtain the threshold voltage and the gate voltage of the second transistor when the light-emitting component is activated. So as to eliminate the impact on the driving current of the light-emitting component caused by the threshold voltage of the second transistor, and to improve the performance of the display.

The above description is merely the embodiments in the present disclosure, the claim is not limited to the description thereby. The equivalent structure or changing of the process of the content of the description and the figures, or to implement to other technical field directly or indirectly should be included in the claim.

What is claimed is:

1. An organic light-emitting diode (OLED) display, comprising:

at least one pixel circuit, wherein the pixel circuit comprises a first transistor, a storage capacitance, a second transistor, a light-emitting component, and a threshold compensation circuit;

a control end of the first transistor connects to an input end of scanning signals, a first end of the first transistor connects to an input end of data signals, and a second end of the first transistor connects to a first end of the storage capacitance;

a control end of the second transistor connects to a second end of the storage capacitance, a first end of the second transistor connects to an input end of first control signals, a second end of the second transistor connects to the first end of the light-emitting component, and a second end of the light-emitting component is grounded;

the threshold compensation circuit is configured to obtain a threshold voltage and a gate voltage of the second transistor when the light-emitting component is activated to eliminate an impact on a driving current of the light-emitting component caused by the threshold voltage of the second transistor;

wherein the threshold compensation circuit comprises: a third transistor, a fourth transistor, a fifth transistor, and a sixth transistor;

wherein a control end of the third transistor connects to the input end of scanning signals, a first end of the third transistor connects to the control end of the second transistor, and the second end of the third transistor connects to the second end of the second transistor;

a control end of the fourth transistor connects to an input end of reset signals, a first end of the fourth transistor connects to an input end of second control signals, and a second end of the fourth transistor connects to the control end of the second transistor;

a control end of the fifth transistor connects to an input end of third control signals, a first end of the fifth transistor connects to the input end of second control signals, and a second end of the fifth transistor connects to the second end of the first transistor;

a control end of the sixth transistor connects to the input end of third control signals, a first end of the sixth transistor connects to the second end of the second transistor, and a second end of the sixth transistor connects to a first end of the light-emitting component;

wherein the input end of reset signals is configured to be at a low potential in a first phase, and is configured to be at a high potential in a second phase and a third phase; and the input end of third control signals is configured to be at the high potential in the first phase and the second phase, and is configured to be at the low potential in the third phase;

the input end of scanning signals is configured to be at the high potential in the first phase and the third phase, and is configured to be at the low potential in the second phase.

2. The OLED display according to claim 1, wherein the first transistor, the second transistor, the third transistor, the fourth transistor, the fifth transistor, and the sixth transistor are P-type thin film transistors (TFTs).

3. The OLED display according to claim 2, wherein the first control signals and the second control signals are direct current (DC) voltage signals.

4. The OLED display according to claim 3, wherein the first control signals are high-level DC voltage signals and the second control signals are low-level DC voltage signals.

5. The OLED display according to claim 1, wherein the light-emitting component is a light-emitting diode (LED).

6. An OLED pixel circuit, comprises: a first transistor, a storage capacitance, a second transistor, a light-emitting component, and a threshold compensation circuit;

a control end of the first transistor connects to an input end of scanning signals, a first end of the first transistor connects to an input end of data signals, and a second end of the first transistor connects to a first end of the storage capacitance;

a control end of the second transistor connects to a second end of the storage capacitance, a first end of the second transistor connects to an input end of first control signals, a second end of the second transistor connects to the first end of the light-emitting component;

the threshold compensation circuit is configured to obtain a threshold voltage and a gate voltage of the second transistor when the light-emitting component is activated to eliminate an impact on the driving current of the light-emitting component caused by the threshold voltage of the second transistor; and wherein the threshold compensation circuit comprises: a third transistor, a fourth transistor, a fifth transistor, and a sixth transistor; a control end of the third transistor connects to the input end of scanning signals, a control end of the fourth transistor connects to an input end of reset signals, a control end of the fifth transistor connects to an input end of third control signals, a control end of the sixth transistor connects to the input end of third control signals; the input end of reset signals is configured to be at a low potential in a first phase, and is configured to be at a high potential in a second phase and a third phase; the input end of third control signals is configured to be at the high potential in the first phase and the second phase, and is configured to be at the low potential in the third phase; the input end of scanning signals is configured to be at the high potential in the first phase and the third phase, and is configured to be at the low potential in the second phase.

7. The OLED pixel circuit according to claim 6, wherein a first end of the third transistor connects to the control end of the second transistor, and the second end of the third transistor connects to the second end of the second transistor;

a first end of the fourth transistor connects to an input end of second control signals, and a second end of the fourth transistor connects to the control end of the second transistor;

a first end of the fifth transistor connects to the input end of second control signals, and a second end of the fifth transistor connects to the second end of the first transistor; and a first end of the sixth transistor connects to the second end of the second transistor, and a second end of the sixth transistor connects to a first end of the light-emitting component.

8. The OLED pixel circuit according to claim 7, wherein the first transistor, the second transistor, the third transistor, the fourth transistor, the fifth transistor, and the sixth transistor are P-type TFTs.

9. The OLED pixel circuit according to claim 8, wherein the first control signals and the second control signals are DC voltage signals.

10. The OLED display according to claim 9, wherein the first control signals are high-level DC voltage signals and the second control signals are low-level DC voltage signals.

11. The OLED display according to claim 6, wherein a second end of the light-emitting component is grounded.

12. The OLED display according to claim 11, wherein the light-emitting component is a LED.

13. A driving method of an OLED pixel circuit, the OLED pixel circuit comprises: a first transistor, a storage capacitance, a second transistor, a light-emitting component, and a threshold compensation circuit;

a control end of the first transistor connects to an input end of scanning signals, a first end of the first transistor connects to an input end of data signals, and a second end of the first transistor connects to a first end of the storage capacitance;

a control end of the second transistor connects to a second end of the storage capacitance, a first end of the second transistor connects to an input end of first control signals, a second end of the second transistor connects to the first end of the light-emitting component;

the driving method comprising:

configuring an input end of reset signals to be at a low potential, an input end of third control signals to be at a high potential, and an input end of scanning signals to be at the high potential in a first phase;

configuring the input end of reset signals to be at the high potential, the input end of third control signals to be at the high potential, and the input end of scanning signals to be at the low potential in a second phase; and configuring the input end of reset signals to be at the high potential, the input end of third control signals to be at the low potential, and the input end of scanning signals to be at the high potential in a third phase.

14. The driving method according to claim 13, wherein the threshold compensation circuit comprises: a third transistor, a fourth transistor, a fifth transistor, and a sixth transistor;

wherein a control end of the third transistor connects to the input end of scanning signals, a first end of the third transistor connects to the control end of the second transistor, and the second end of the third transistor connects to the second end of the second transistor;

a control end of the fourth transistor connects to the input end of reset signals, a first end of the fourth transistor connects to an input end of second control signals, and a second end of the fourth transistor connects to the control end of the second transistor;

a control end of the fifth transistor connects to the input end of third control signals, a first end of the fifth transistor connects to the input end of second control signals, and a second end of the fifth transistor connects to the second end of the first transistor;

a control end of the sixth transistor connects to the input end of third control signals, a first end of the sixth transistor connects to the second end of the second transistor, and a second end of the sixth transistor connects to a first end of the light-emitting component.

15. The driving method according to claim 14, wherein the first transistor, the second transistor, the third transistor, the fourth transistor, the fifth transistor, and the sixth transistor are P-type TFTs.

16. The driving method according to claim 15, wherein the first control signals and the second control signals are DC voltage signals.

17. The driving method according to claim 16, wherein the first control signals are high-level DC voltage signals and the second control signals are low-level DC voltage signals.

* * * * *